United States Patent [19]

Stirm

[11] Patent Number: 5,071,069

[45] Date of Patent: Dec. 10, 1991

[54] HAND-HELD HIGH-PRESSURE CLEANER

[75] Inventor: Michael Stirm, Oberursel, Fed. Rep. of Germany

[73] Assignee: Black & Decker Inc., Newark, Del.

[21] Appl. No.: 586,862

[22] Filed: Sep. 21, 1990

[30] Foreign Application Priority Data

Sep. 23, 1989 [DE] Fed. Rep. of Germany ..... 3931814

[51] Int. Cl.[5] ..... B05B 1/00; B05B 9/01

[52] U.S. Cl. ..... 239/128; 239/525

[58] Field of Search ..... 239/128, 332, 380, 525, 239/526, 132–132.5; 417/366, 371

[56] References Cited

U.S. PATENT DOCUMENTS 4,480,967 11/1984 Schulze ..... 417/371

FOREIGN PATENT DOCUMENTS 0177925 4/1986 European Pat. Off. .
312862 4/1989 European Pat. Off. ..... 239/332
3001571 7/1981 Fed. Rep. of Germany .
3115698 12/1982 Fed. Rep. of Germany .
3612936 10/1987 Fed. Rep. of Germany .
8713954 1/1988 Fed. Rep. of Germany .
2384558 10/1978 France .
82779 6/1971 German Democratic Rep. .
607731 10/1978 Switzerland .
379039 8/1932 United Kingdom .
2099232 1/1985 United Kingdom .

*Primary Examiner*—David M. Mitchell
*Assistant Examiner*—Lesley D. Morris
*Attorney, Agent, or Firm*—Dennis A. Dearing; Charles E. Yocum; Edward D. C. Bartlett

[57] ABSTRACT

A hand-held high-pressure cleaner has a pump, which is driven by a universal motor. The universal motor is positioned together with the fan attached to its armature shaft in an air-tight and water-tight sealed motor chamber of the tool-casing of the high-pressure cleaner. In this motor chamber a radiator or cooler, through which cleaning fluid flows, is provided for cooling the air circulated by the fan.

16 Claims, 4 Drawing Sheets

HAND-HELD HIGH-PRESSURE CLEANER

BACKGROUND OF THE INVENTION

The invention relates to a hand-held high-pressure cleaner provided with an electromotor in a tool-casing, and having a fan provided on its armature shaft, which motor is to drive a pump, the inlet of which can be connected with a source of cleaning fluid, preferably water, and the outlet of which is connected or can be connected with an outlet nozzle, and with at least one handle region for holding the high-pressure cleaner when in operation.

A known high-pressure cleaner of this type (German Utility Model No. 87 13 954) has a tool-casing with a pistol grip, and the electromotor, which drives an axial piston pump arranged in the tool-casing, is located in a region of the tool-casing which projects to the rear.

A problem with this known hand-held high-pressure cleaner is that the electromotor must be positioned in a water-tight casing, because the hand-held high-pressure cleaner is operated in a damp environment and in particular there is always the possibility that either the user will lay the hand tool down on a wet surface or drop it into a wet area, or that it will be operated in an environment where cleaning fluid is also sprayed in the region of the rear part of the tool-casing. If the electromotor is in a water-tight casing it is, however, difficult to cool it sufficiently when it is operating.

It is known in high-pressure cleaners (EP Publication No. 0 177 925) which are operated when stationary for the motor housing to be constructed with double walls and for the cold cleaning fluid to be passed through the annular space thus obtained, which is optionally subdivided by a helical separating wall, so that the electromotor is cooled in this way. However, only relatively little heat can be dissipated with this cooling system because only the inner surface of the motor housing is available for heat transfer and the stator laminations of the motor are in contact therewith over a large axial area while the windings, which become hot, are situated at a clear distance from the housing wall. For this reason this type of cooling is only suitable for those electromotors which produce little heat relative to their dimensions, for example, induction motors, i.e. electromotors, which are relatively large relative to the power they produce. Such motors are, however, unsuitable for use in hand-held high-pressure cleaners because the resulting dimensions would be too large and the weight too high.

It is the object of the invention to provide a hand-held high-pressure cleaner with a compact and light construction.

SUMMARY OF THE INVENTION

According to the present invention, a hand-held high-pressure cleaner comprising an electromotor in a tool-casing, and a fan provided on its armature shaft, which motor is to drive a pump, the inlet of which can be connected with a source of cleaning fluid, preferably water, and the outlet of which is connected or can be connected with a spray nozzle, and further comprising at least one handle region for holding the high-pressure cleaner when in operation, is characterized in that the electromotor is a universal motor which is positioned together with the fan in an air-tight and water-tight sealed motor chamber in the tool-casing, and that in the motor chamber a radiator or cooler through which the cleaning fluid flows is provided for cooling the air circulated by the fan.

Therefore, in order to achieve the object of the present invention a high-pressure cleaner of the type mentioned in the introduction is formed such that the electromotor is a universal motor which is positioned together with the fan in an air-tight and water-tight sealed motor chamber in the tool-casing, and that in the motor chamber a radiator or cooler is provided, through which the cleaning fluid flows, to cool the air circulated by the fan.

In the high-pressure cleaner according to the invention a universal motor is used which is known to produce a high drive power with a compact construction, but as a consequence also heats up considerably and therefore requires effective cooling. This universal motor and the fan provided on its armature shaft is housed air-tight and water-tight in a tool-casing together with a radiator or cooler through which the cleaning fluid flows, so that the high-pressure cleaner can be used in a damp environment without any resulting danger to the operator or there being any need to fear damage to the motor due to the damp environment.

As already mentioned, a considerable generation of heat results from the operation of the universal motor, and the heat is dissipated in the usual manner by an air stream which is circulated by the fan and passed through the motor and directly over the heated windings, but remains in the sealed motor chamber and is passed therein over the radiator or cooler through which the cleaning fluid flows, so that there results an effective heat transfer to the cleaning fluid and therefore an effective cooling of the circulated air.

The radiator or cooler is preferably the only connection between the source of the cleaning fluid and the inlet of the pump, so that all of the cleaning fluid to be discharged under high pressure through the outlet nozzle flows through the radiator or cooler and as a result the heat transfer from the circulated air to the radiator or cooler is improved.

The radiator or cooler preferably lies in the flow path of the circulated air between the fan and the end of the electromotor facing away from the fan, so that the air drawn in by the fan is passed across the radiator or cooler and is then drawn into the electromotor again at the end of the electromotor remote from the fan.

In order to improve the effect of the radiator or cooler further, it can be provided with cooling ribs or fins which together with the wall sections of the motor chamber form flow paths for the circulated air. As a result the air is kept in contact with the surface of the radiator or cooler over a long flow path so that it is well cooled when it enters the universal motor again.

To enable the operator to hold the high-pressure cleaner easily when it is in operation and to be able to direct it, a spade handle serving as a handle can be formed at the rear end of the tool-casing.

The pump housing can be held clamped and also axially undisplaceable and unrotatable at one end of the tool casing, so that it partly projects out of the tool casing and the outlet nozzle can be attached to it.

BRIEF DESCRIPTION OF THE DRAWINGS

The invention is explained in more detail with reference to the accompanying drawings showing an embodiment.

DETAILED DESCRIPTION OF THE PREFERRED EMBODIMENT

Figure 1:
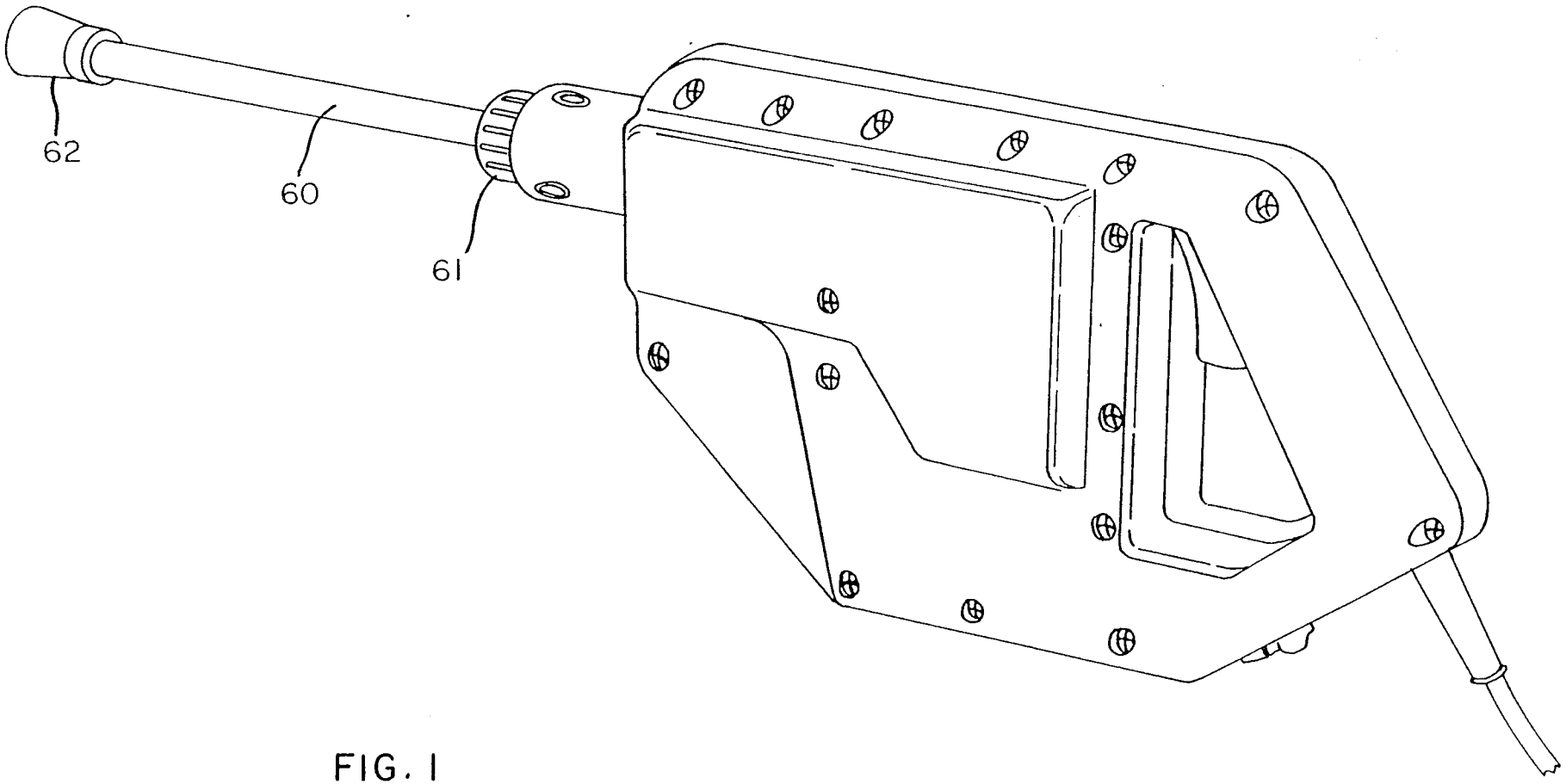
FIG. 1 shows a perspective view of a hand-held high-pressure cleaner.
Figure 2:
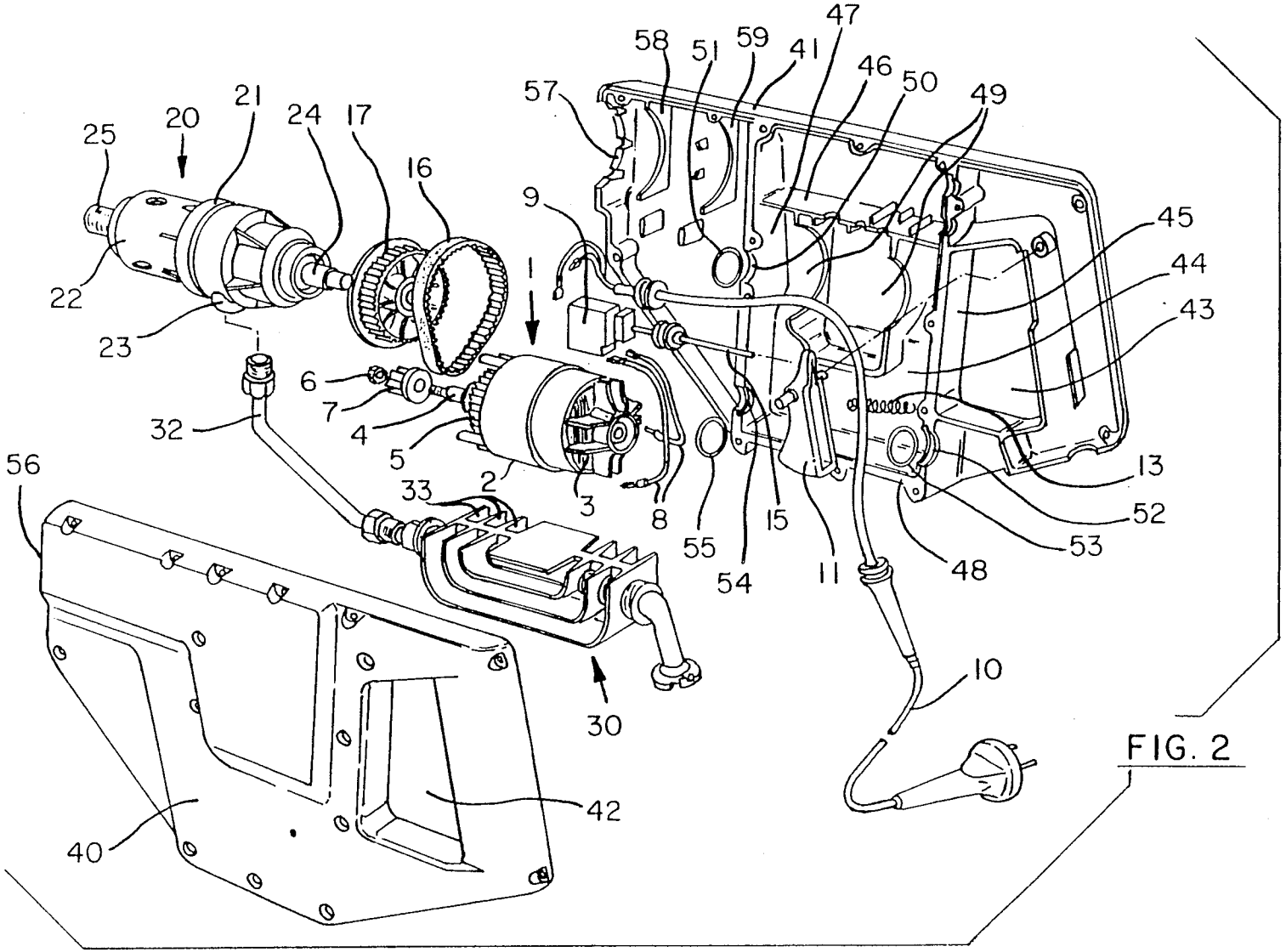
FIG. 2 shows an exploded view of the basic parts of the high-pressure cleaner of FIG. 1, with the outlet nozzle and its connections omitted.
Figure 3:
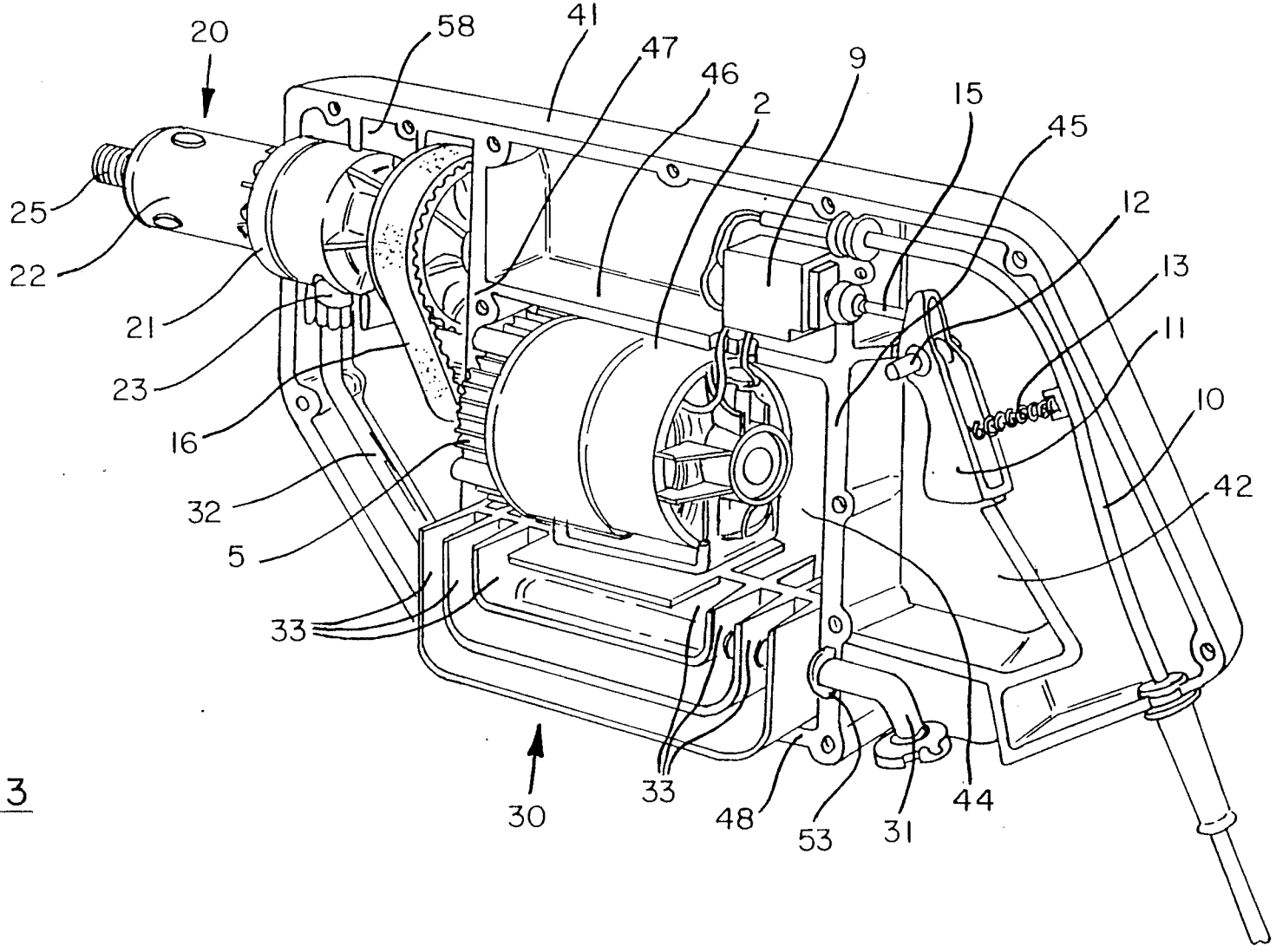
FIG. 3 shows a perspective view of the components positioned between the two half shells of the casing of FIG. 2 inserted into one casing half.

The hand-held high-pressure cleaner shown in FIGS. 1 to 3 is, as can be seen from FIG. 1, a device which is held by the user when in operation, and which is handled and brought into its working position in a corresponding way to a portable electrical power tool, such as a rotary hammer.

The high-pressure cleaner has a tool-casing, consisting of two half-shells 40, 41 separated along a middle plane, in which a universal motor and a radiator or cooler are housed in a manner to be described below. In the tool-casing a motor chamber 44 is formed which is defined in the half shell 41 by walls 45, 46, 47 and 48 and in the half shell 40 by the corresponding walls, not shown, and which, when assembled, i.e. when the two half shells 40 and 41 are joined together by screws in the usual manner, is sealed air-tight and water-tight to the surroundings, optionally by interconnecting a surrounding seal.

In the rear portion of the tool-casing, handle openings 42, and 43 are formed in the half shells 40, 41, which when the casing halves 40, 41 are assembled, form what is known as a "spade handle". The actuating element 11, which is pivotally mounted on a pin 12 and can be pushed against the pressure of a spring 13 into the handle area of the tool-casing, extends into the opening of the spade handle, and due to a spring pressure for an on/off switch 9 can be brought into the on-position via an axially mounted push-rod 15 and returns automatically into the off-position when the actuating element is released. The switch 9 can be connected to a normal plug socket via a cable 10 leading to the outside.

The switch 9 is further connected by connection wires 8 to the universal motor 1, which has a motor housing 2 partly surrounding the stator, in which an armature is mounted in the usual manner, which carries a commutator on the end 3 to the right in FIGS. 2 and 3 which engages with carbon brushes, not shown. At the end facing away from end 3, a conventional fan 5 is mounted on the armature shaft 4. On the end of the armature shaft 4 nearest the fan 5, a gear wheel 7 is unrotatably attached which is held undisplaceably on the armature shaft 4 by means of a nut 6.

The gear wheel 7 is connected by means of a toothed belt 16 to a gear wheel 17, the diameter of which is considerably greater than the diameter of the gear wheel 7 and which is unrotatably mounted on the pump shaft 24 of an axial piston pump 20, as shown for example in EP Publication No. 0 177 925. The pump 20 has an annular housing section 21, on to which a cylindrical section 22 of smaller diameter connects from the front, while the pump inlet 23 is provided between the free end of the pump shaft 24 and the annular section 21. Coaxial to the pump shaft 24, there extends forward from the housing section 22 a pipe-shaped connecting piece 25 with external thread, onto which by means of a connector nut 61 a spray lance can be attached in the form of a pipe 60 with a spray nozzle 62 provided at the front end.

A pipe 32 which is connected with the radiator or cooler 30 is attached in the usual manner to the pump inlet 23. On the end of the radiator 30 facing away from the connection for the pipe 32 a pipe connecting piece 31 is attached, the free end of which can be connected with a source of cleaning fluid by means of a coupling indicated schematically, e.g. a bayonet coupling, with water usually being employed as the cleaning fluid.

As can be seen in particular from FIGS. 2 and 3, the universal motor 1 and the radiator 30 are both inserted into the motor chamber 44. The universal motor 1 is held in its position in the motor chamber 44 by wall sections of the half shells with semi-circular recesses 49, and its armature shaft 4 is supported with a bearing, not shown, in a recess 50 in the wall 47 of the motor chamber 44, which recess is sealed to the outside by an O-ring 51. The connection wires 8 between switch 9 and universal motor 1 are passed through the wall 46 of the motor chamber 44, and the switch 9 is situated in a switch chamber formed above the motor chamber 44 in the tool-casing formed by the half-shells 40 and 41, the lower wall of which switch chamber is wall 46. The actuating rod 15 and the power cable 10 pass out of the switch chamber through seals.

The radiator 30 is located below the universal motor 1 in the motor chamber 44. The radiator has been selected so that it is of such a size that, together with the cooling ribs or fins 33 formed on it, it fills essentially all the free space in the motor chamber below the universal motor 1, and so that between the cooling ribs 33 air ducts are formed which are limited to the sides by the walls of the half shells 40,41. The input pipe 31 of the radiator 30 passes out through an opening 52 in the wall 45 of the motor chamber 44 and is sealed against the motor chamber wall by means of an O-ring 53. The coupling formed at the free end of this inlet pipe 31 for connection with a water hose or the like is located in a downwardly open recess formed by the tool-casing, and is therefore accessible to the user.

The outlet pipe 32 of the radiator 30 passes through a recess 54 in the wall 47 of the motor chamber 44 and is sealed against the motor chamber walls by means of an O-ring 55.

In this way, while electrical connection wires 8 and the inlet pipe 31 of the radiator 30 lead into the motor chamber 44, and the armature shaft 4 of the universal motor 1 and the outlet pipe 32 of the radiator 30 extend out of it, the motor chamber 44 is nevertheless hermetically sealed from the environment, i.e. it is sealed air-tight and water-tight.

When assembled as in FIG. 3, the gear wheel 7 mounted on the armature shaft 4 is located outside the motor chamber 44 in a front chamber of the tool-casing formed by the half shells 40 and 41, which can be described as the drive chamber. Into this drive chamber the rear end of the pump 20 extends which is held clamped in the tool-casing by two half-shell formed sections 56, 57 in the casing halves 40 and 41, which grip around the cylindrical housing region 22 of the pump 20. The annular section 21 of the pump housing and the ribs extending forward from it lie between the inner ends of the half-shell-formed sections 56 and 57 and supporting projections 58, so that the pump 20 is secured against axial displacements. Moreover, the pump housing rests with its inner end in a recess formed by casing projections 59, and lugs, not shown, which are formed between the casing projections 58 and 59 in the casing half-shells and secure the pump housing against rotation by engaging with corresponding axially parallel projections on the pump housing.

When the pump 20 is thus assembled, the pump shaft 24 runs parallel to the armature shaft 4, and the gear wheel 17 seated on the pump shaft 24 is in alignment with the gear wheel 7 of the armature shaft above it. The two gear wheels are, as can be seen in FIG. 3, coupled by an endless toothed belt 16, forming a speed reduction drive so that on rotation of the armature shaft 4 the pump 20 is correspondingly driven.

Figure 4:
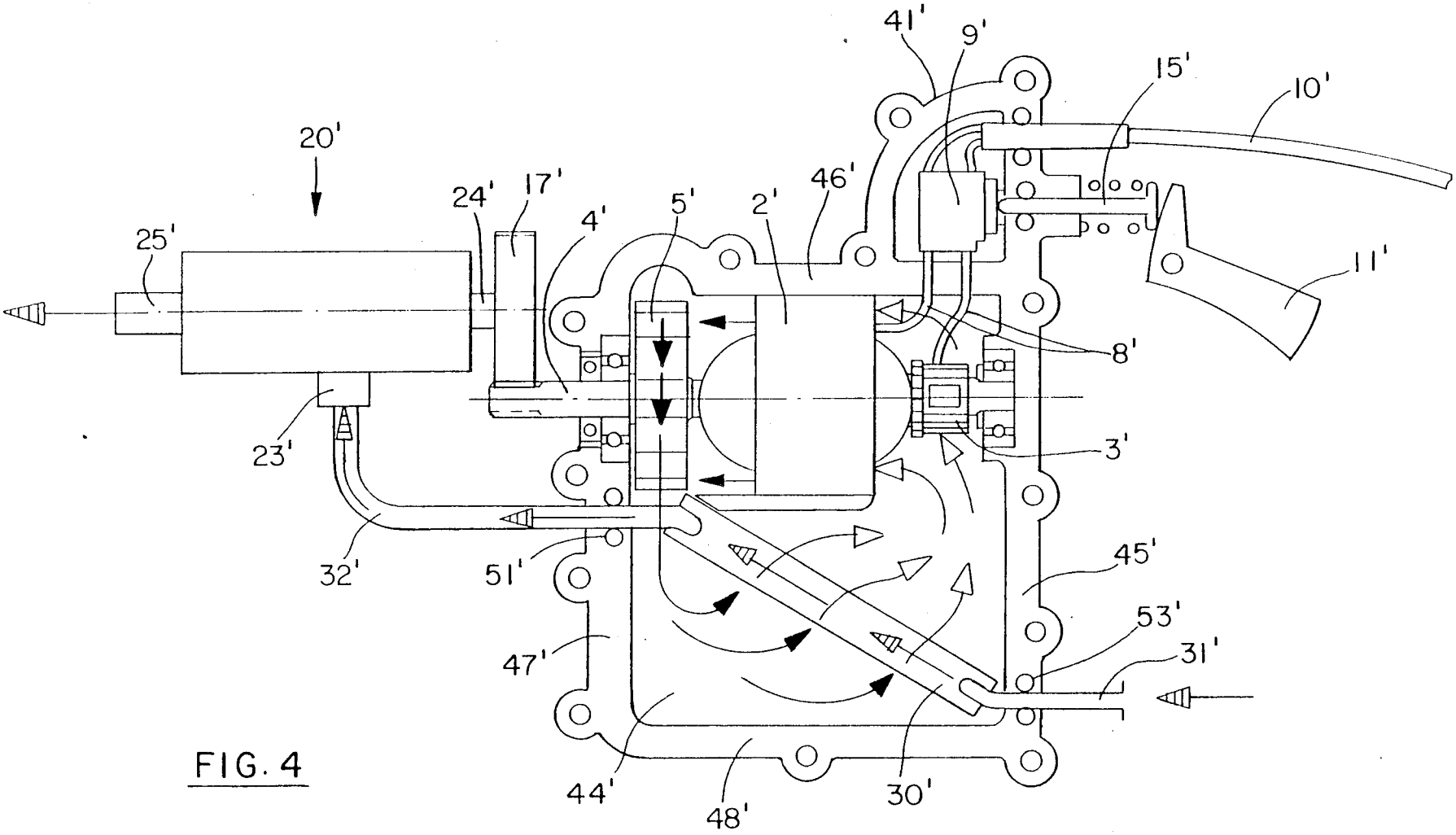
FIG. 4 shows an illustration of the principles of a hand-held high-pressure cleaner to explain the way it operates.

For simplification, the way the hand-held high-pressure cleaner described above operates is described using the schematic representation in FIG. 4, in which for the same or corresponding parts as those in FIGS. 1 to 3 the same reference numerals are used but marked additionally with '. These parts are not described again.

To put the tool into operation, the inlet pipe 31' of the radiator 30' is connected with a water connection or the like and the plug at the free end of the power cable 10' is inserted into the normal electricity supply socket. If, when the device is in this ready-to-operate condition, the switch-actuating element 11' is pivoted and the switch 9' is thus brought into the on-position, a voltage is applied to the universal motor and its armature rotates. Thus the rotating armature shaft 4', which is in drive connection with the toothed wheel 17' seated on the pump shaft 24', drives the pump 20' so that standing water from the connecting pipe 31' through the radiator 30' and the pipe 32' to the pump inlet 23' is forced out of the pump outlet 25 under high pressure, e.g. pressure of 70 bar to 100 bar, and is thus discharged from the spray nozzle 62 in FIG. 1.

On the rotation of the armature shaft 4', the fan wheel 5' of the universal motor which is located in the motor chamber 44' also rotates and circulates air in the manner indicated, whereupon the fan 5' in this case draws air from right to left (FIG. 4) through the universal motor, which dissipates the operational heat of the universal motor by direct contact with the windings. The thus heated air, indicated by dark arrows, is passed over the radiator 30' and its cooling ribs 33, not shown in FIG. 4. Because all the cleaning fluid from the cleaning fluid source flows through the radiator 30', and this cleaning fluid is cold compared with the air heated by the universal motor, the air transfers a considerable amount of heat to the cooler 30', and this heat is dissipated by the cleaning fluid. The thus cooled air, which is indicated by arrows which have not been blacked, is drawn from the fan 25 ' through the universal motor again in the manner shown and is thus used for cooling.

As can be seen, a circulation of air results in the hermetically sealed motor chamber 44', so that air which has dissipated heat from the universal motor flows over the radiator 30' and there delivers its heat to the cleaning fluid flowing through, so that the air is again available for cooling purposes. As can be seen particularly from FIG. 3, the air is thus guided through the cooling ribs 33, which have portions extending parallel to the radiator passage and other portions traversing the passage, of the radiator 30 such that the hot air conveyed by the fan 5 enters between the cooling ribs 33 at the end of the radiator 30 nearest the fan 5 and then flows along a set path over the cooling ribs 33 in the direction of the other end of the radiator 30. At this end the now cooled air exits and is at the end of the universal motor 1 opposite the fan 5, so that it enters the universal motor 1 again there due to the suction effect of the fan 5.

The above described embodiment, of course, is not to be construed as limiting the breadth of the present invention. Modifications, and other alternative constructions, will be apparent which are within the spirit and scope of the invention as defined in the appended claims.

I claim:

1. A hand-held high-pressure cleaner, comprising:

a tool-casing;

a universal motor having an armature shaft;

a fan mounted on the armature shaft for passing air through said motor;

a pump driven by said motor and having an inlet and an outlet;

said inlet being connectable, in use, to a source of cleaning fluid;

said outlet being connected to a spray nozzle;

an air-tight and water-tight sealed motor chamber in said tool-casing, said motor and said fan both being located in said sealed motor chamber;

a radiator also located in said sealed motor chamber, said radiator being connected, in use, between the source of cleaning fluid and said pump inlet to create flow of cleaning fluid through said radiator; and said radiator having cooling ribs or fins, which together with walls sections of said motor chamber, form return flow-paths for the air passed through said motor, said fan circulating the air through said motor and said flow paths with the circulated air being cooled during passage through said flow paths before re-passing through said motor.

2. The high-pressure cleaner according to claim 1, wherein said radiator is the only connection between the source of cleaning fluid and the inlet of the pump.

3. A hand-held high-pressure cleaner, comprising:

a tool-casing having therein a sealed motor chamber;

a pump supported by said tool-casing;

a spray nozzle connected to said pump;

an electric motor housed in said sealed motor chamber, said motor having an armature shaft with a fan mounted thereon, said fan passing cooling air through an interior of said motor;

said pump being driven by said armature shaft for pumping, in use, cleaning fluid to said nozzle from a cleaning fluid inlet connection of the high-pressure cleaner;

a radiator housed in said sealed motor chamber;

said radiator having a plurality of air paths therethrough which communicate with said fan and said motor interior, said fan circulating air in closed circuit through said motor interior and said air paths; and said radiator having a passage therethrough for the cleaning fluid, said passage being connected between said cleaning fluid inlet connection and said nozzle with said radiator, in use, effecting cooling of said circulating air by the cleaning fluid.

4. The hand-held cleaner of claim 3, wherein said radiator is disposed to one side of said motor.

5. The hand-held cleaner of claim 3, wherein said radiator is formed as a separate unit from said motor and is located in said sealed motor chamber below said motor, each said air path communicating at opposite ends with opposite ends of said motor.

6. The hand-held cleaner of claim 3, wherein said motor is a universal motor having a commutator end, said fan being mounted adjacent an opposite end of said motor.

7. The hand-held cleaner of claim 6, wherein said pump is located at a forward end of said tool-casing, and said fan is located between said motor and said pump.

8. The hand-held cleaner of claim 3, wherein said radiator has a plurality of spaced-apart fins between which said air paths extend, said fins having intermediate portions extending parallel to said cleaning fluid passage and end portions directed transversely away from the intermediate portions towards ends of said motor.

9. The hand-held cleaner of claim 3, wherein said passage extends through said radiator parallel to said armature shaft.

10. The hand-held cleaner of claim 9, wherein:

said passage is formed by a tube;

said radiator has cooling fins between which said air paths extend;

said air paths having sides formed by side walls of said motor chamber; and said fins having mid-portions which extend parallel to said tube and end portions which traverse said tube.

11. The hand-held cleaner of claim 3, wherein:

said pump is located at a forward end of said tool-casing, and a handle is formed at a rear end of said tool-casing;

said tool casing has therein a drive compartment forward of said motor chamber, said armature shaft extending in sealed relationship through a forward wall of said motor chamber into said drive compartment, and a rear end of said pump being disposed in said drive compartment; and a speed reduction drive in said drive compartment drivingly connecting said armature shaft to said pump.

12. The hand-held cleaner of claim 3, wherein said motor partially fills said motor chamber with free space remaining in said motor chamber alongside said motor, and said radiator is disposed in and fills said free space.

13. A hand-held cleaner, comprising:

a tool-casing having a spray lance at a forward end and a handle formed at a rear end;

a motor chamber and a separate but adjacent drive compartment being disposed in said tool-casing, said motor chamber being hermetically sealed and being rearward of said drive compartment;

a universal motor mounted in said motor chamber with an armature shaft of said motor extending forwardly into said drive compartment;

a pump mounted at said forward end with said spray lance extending from said pump, said pump having a rear end disposed in said drive compartment;

a radiator mounted in said motor chamber separately from and below said motor;

said radiator having a passage extending therethrough from a rear to a front of said motor chamber, a rear end of said passage being connected to an inlet connection for cleaning fluid, and a forward end of said passage being connected to an inlet of said pump;

said radiator having a plurality of cooling ribs defining with side walls of said motor chamber a plurality of flow-paths for cooling air, ends of said flow-paths communicating with opposite ends of said motor, portions of said flow paths extending parallel to said passage and other portions of said flow paths traversing said passage;

a fan disposed in said motor chamber and mounted on said armature shaft adjacent said drive compartment, said fan circulating cooling air interiorly through said motor and through said flow-paths, the cooling air cooling the motor and being in turn cooled by cleaning fluid passing through said radiator passage, the so cooled air then re-circulating through said motor; and a reduction drive in said drive compartment drivingly connecting said armature shaft to said pump.

14. The hand-held cleaner of claim 13, wherein said motor partially fills said motor chamber with free space remaining in said motor chamber below said motor, and said radiator fills said free space.

15. The hand-held cleaner of claim 13, wherein said reduction drive comprises gear wheels drivingly connected by an endless toothed belt.

16. The hand-held cleaner of claim 13, wherein said motor is mounted in recesses in interior vertical wall sections in said motor chamber, and said radiator is disposed below said wall sections and adjacent a bottom wall of said motor chamber, said motor and said radiator together filling said motor chamber.

* * * * *